United States Patent [19]

Volk et al.

[11] Patent Number: 4,726,290

[45] **Date of Patent: * Feb. 23, 1988**

[54] PRINTING BAND, IN PARTICULAR FOR PRICE MARKING DEVICES

[75] Inventors: Heinrich Volk, Beerfelden-Gammelsbach; Karl Harter, Furtwangen, both of Fed. Rep. of Germany

[73] Assignee: Esselte Meto International GmbH, Fed. Rep. of Germany

[ * ] Notice: The portion of the term of this patent subsequent to Sep. 22, 2004 has been disclaimed.

[21] Appl. No.: 947,184

[22] Filed: Dec. 29, 1986

Related U.S. Application Data

[62] Division of Ser. No. 744,229, Jun. 13, 1985, Pat. No. 4,694,745.

[30] Foreign Application Priority Data

Jun. 16, 1984 [DE] Fed. Rep. of Germany ..... 3422456

[51] Int. Cl.[4] ..... B41J 1/60

[52] U.S. Cl. ..... 101/111; 101/105; 101/DIG. 27

[58] Field of Search ..... 101/105, 109, 110, 111, 101/DIG. 27

[56] References Cited

U.S. PATENT DOCUMENTS

| | | | |
|---|---|---|---|
| 1,174,954 | 3/1916 | Anthony | 101/111 X |
| 3,791,292 | 2/1974 | Soderstrom et al. | 101/111 |
| 4,006,680 | 2/1977 | Grau, Jr. et al. | 101/111 X |
| 4,119,030 | 10/1978 | Funahashi | 101/111 |
| 4,290,358 | 9/1981 | Hamisch, Jr. | 101/111 |
| 4,337,698 | 7/1985 | Jenkins | 101/111 |

FOREIGN PATENT DOCUMENTS

| | | | |
|---|---|---|---|
| 2235394 | 3/1973 | Fed. Rep. of Germany | 101/111 |
| 24486 | 2/1983 | Japan | 101/111 |

OTHER PUBLICATIONS

IBM Tech. Disc. Bulletin, "Type Slug Mounting", Hereeg, vol. 13, No. 2, Jul. 1970, p. 346.

*Primary Examiner*—Edgar S. Burr
*Assistant Examiner*—James P. McDaniel
*Attorney, Agent, or Firm*—Gerald J. Ferguson, Jr.; Michael P. Hoffman; Michael J. Foycik, Jr.

[57] ABSTRACT

An endless printing band (1) consists preferably of rubber or synthetic rubber and in its production is cut from a hose-like blank by cuts extending along its edge. Said printing band (1) has in the one region of its outer side visually readable characters (3) and in an opposite region laterally inverted raised printable characters (5). In the region of the readable characters (3) on the inner side (11) of the printing band (1) inwardly projecting cams (6) are provided for the advance of the band while the inner side (7) of the region comprising the printable characters (5) is smooth. To nevertheless ensure at both band regions equal amounts of material for as uniform as possible shrinkage in the production of the printing band (1) in the region of the transport cams (6) on the outer side of the band (1) remote from the cams (6) recesses (9) are provided whose lowermost point (10) lies beneath the center of the band (1) between the cams (6) and preferably substantially at the height of the inner side (11) of said band region between the cams (6). As a result, at the run (2) of the band (1) having cams (6) and the likewise raised readable characters (3) so much material is saved that the material accumulation of the two band regions or runs (2 and 4) is substantially the same and this gives the same shrinkage in the production.

2 Claims, 7 Drawing Figures

PRINTING BAND, IN PARTICULAR FOR PRICE MARKING DEVICES

Figure 2:
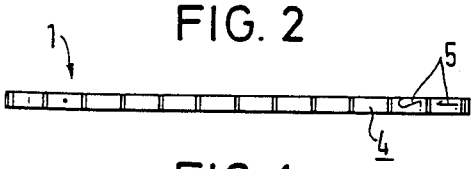

This is a divisional of Ser. No. 744,229, filed June 13, 1985, which is now U.S. Pat. No. 4,694,745.

The invention relates to a printing band, preferably of rubber or synthetic rubber, in particular for price marking devices, which is made endless and at one run at its outer side comprises visually readable characters or digits and at the opposite run respective printable characters or digits disposed laterally inverted, and beneath the readable characters or digits respective inwardly projecting cams are disposed for the advance of the printing band whilst the inner side of the printing band is smooth in the region of the printable characters or digits and in each case between adjacent digits or characters recesses extending from the outside inwardly are provided for selective band weakening.

Such printing bands are known and are used primarily in price marking devices where rapid adjustability but nevertheless precise printing is important. The user sets a visually readable character, preferably a digit, at an appropriate observation point. This then corresponds also to the printing position of the corresponding laterally inverted character at the other band run or strand. In this setting and exact positioning of the printable characters the recesses disposed between the individual characters are important and serve as hinges for the appropriate band movements.

With such printing bands there is the problem that the cams disposed beneath the readable characters represent an accumulation of the material of the printing band which is not present in the second run or strand with the printable characters. Since the individual printing bands of individual consecutively disposed printable characters are cut from correspondingly formed hoses with such parallel characters, to permit maximum economy of production of these endless bands. because the material after the production of said hose sections or hoses depending on the accumulation of the material shrinks to a greater or lesser extent, there is a danger that with a plurality of bands to be cut off in succession, using of course automatic cutting means, because of the different shrinkage summation errors can occur and the last bands severed are wasted because a cut is made into the digits. It must also be remembered that the individual printing bands are very narrow and must have a high dimensional accuracy with low tolerances so that within a given price marking device several such printing bands can be arranged adjacent to each other and movable relatively to each other and nevertheless still be able for example to print labels which can be read optoelectronically.

There is therefore the problem of providing a printing band of the type mentioned at the beginning in which cutting errors in spite of the close proximity of the parallel rows of characters on the blank or hose portion are avoided in that the requirement is met for a substantially uniform shrinkage both on the side of the readable characters and on the side of the printable characters. Nevertheless, adequately large cams are to be present in the region of the visually readable characters for a precise movement of the band and as a whole the printing band is not to be too unyieldable and/or too soft either in the region of the printable characters or in the region of the readable characters. An increase in the material accumulation at the run comprising the printable characters is to be avoided.

The solution of this apparently contradictory problem resides essentially in that the run of the printing band comprising the readable characters comprises in the region of the transport cams on its outer side remote from the cams recesses.

In this manner the total mass of the band material is reduced at the run of the endless band where because of the transport cams in effect a greater material accumulation is present.

For a reduction of the material accumulation at the run comprising the readable characters it is particularly expedient if the lowest point, seen from the outside, of individual or of all recesses lies substantially at the level of the inner side of the printing band between the cams. This gives the greatest possible depth of the recess also for the case still to be mentioned where the printing band is reinforced with reinforcing filaments. As a result, cams projecting a relatively great distance can be used but there is still at the run of the readable characters only approximately as much material as at the other run so that the shrinkage of the two runs in the production is identical or almost identical. Tests have shown that in this manner erroneous cuts are avoided in spite of the narrow tolerances and the rows of characters closely adjacent each other in the hose-like blank, at least with a conventional number of such rows.

In an already mentioned printing band with reinforcing filaments extending through in the longitudinal direction thereof in accordance with a further development of the invention of independent protectable significance it is expedient if the reinforcing filaments on the one hand extend between the cams substantially in the region of the surface of the band inner side and on the other hand in the region of the lowest points of the recesses. The position of the reinforcing filaments thus defines the two major boundary faces of this portion of the printing band, i.e. on the one hand between the cams of the band inner side and on the other in the cams the surface of the lowest point of the recesses.

The depth of the recess could be reduced with respect to the inner side of the band between the cams by the thickness of the reinforcing filaments and the latter could thus be embedded into the band material.

In a preferred and expedient embodiment, however, for a still greater reduction of the material accumulation at the run comprising the cams it is expedient if the reinforcing filaments project with their cross-section partially beyond at least one of the boundary faces—at the lowest point of the recess and/or the inner side of the band between the cams—and in their projecting region are preferably coated with rubber or a similar material. Thus, in this case the centre of the reinforcing filaments practically forms the level up to which the recess can extend into the depth of the band. Nevertheless, the reinforcing filaments can extend round the endless band in the lengthwise direction thereof. The partially projecting reinforcing filaments may form a grooved structure oriented in the longitudinal direction. It is thus possible for the recesses in the region of the transport cams to extend in fact up to the height of the inner side of the band between the cams or possibly even somewhat beyond when more than half the reinforcing filaments is exposed within the recess. By these steps the greatest amount of material is saved at the recesses without the rectilinear path of the reinforcing filaments being changed so that otherwise the band portions, in particular the run comprising the printable characters and also the transport cams, can have their necessary dimensions and nevertheless the amounts of material present at the two runs are substantially identical so that the same degrees of shrinkage occur. Thus, with high precision it is possible even with a great number of parallel rows of characters to cut from a tubular blank a great number of printing bands without cutting errors and waste occurring due to different shrinkages.

To save material as far as possible in the region of the recesses it is expedient if the recesses are led downwards up to their lowermost position along the contours of a character extending in the centre region of said character or digit. The raised character thus has its greatest height in the region of the recess. This saves the maximum amount of material in the region of this character and thus of the transport cam disposed at the inner side at this point. Thus, in the tubular blanks not yet cut to individual endless bands over the transverse direction thereof in the region of the characters a groove is formed from which said characters or digits project upwardly.

In the case of punctiform or dash-shaped print characters an expedient variant is that within the recess for such a character which would completely enclose the latter support webs are disposed in the longitudinal direction of the band to secure such filigree characters from lateral pivoting or tilting.

The recesses in the region of the readable digits may in each case be open upwardly and at the lateral edge of the band. It is further possible for the recesses to be provided within cavities of closed print characters, for example a zero, an 8, a D or the like. Thus, a corresponding reduction of material by forming the depression or recess is obtained not only at the outside but also at the inner contour of the characters.

The dimension of the recess provided in the longitudinal or peripheral direction of the printing band may be smaller than the dimension of the respective character in this direction and in the case of a dot provided at a character, for example a dot for distinguishing the digit 6 from the digit 9, said dot may preferably be disposed outside the recess substantially at the edge thereof. As a result, not only the end regions of the characters lying in the peripheral direction are elevated to a lesser extent with respect to their surroundings than is the case within the recess, leading to a corresponding stabilization of the characters, but also there is room for such additional characters next to the characters. Such dots are frequently also necessary for characters which in a price marking must be the last digit of the imprint.

In particular on combining individual or several of the features and steps described above a printing band is obtained having on the one hand visually readable and on the other printable characters in which in spite of the different configuration of the two runs of said printing band at said two runs substantially the same amount of material is used so that in the production of such a printing band preferably from rubber or synthetic rubber identical shrinkages occur and rows of printable characters formed in the blank retain their arrangement relatively to each other so that cutting errors and waste are avoided.

Figure 1:
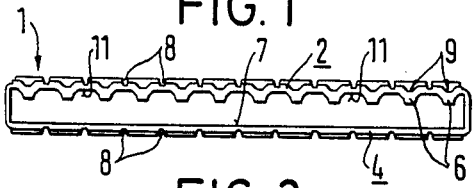
Figure 3:
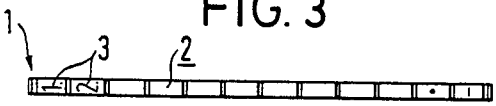
Figure 4:
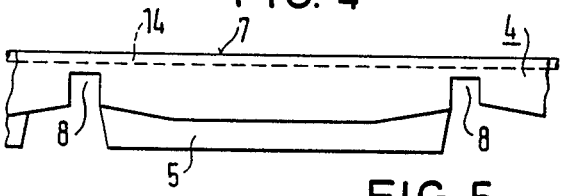
Figure 5:
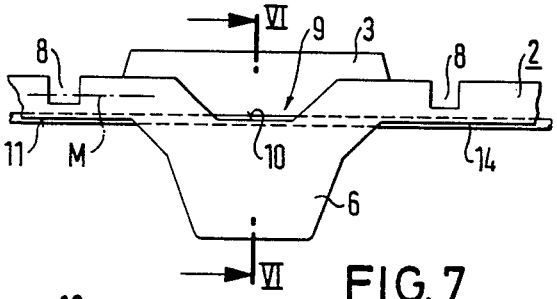
Figure 6:
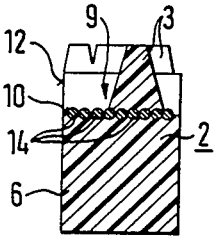
Figure 7:
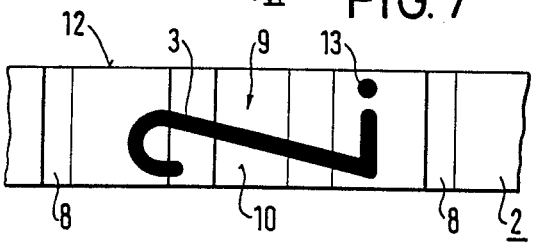

The invention will be explained hereinafter in its essential details with the aid of the drawings, wherein FIG. 1 is a side view of an endless printing band, the upper run having the readable characters and the lower run the printable characters, FIG. 2 is a view of the lower run with the laterally inverted symmetrically arranged printable characters, FIG. 3 is a view of the upper run with the readable characters, to an enlarged scale, FIG. 4 is a side view of a fragment of the lower run with a printable character and hinge recesses disposed on either side, FIG. 5 is a side view of a region of the upper run with a readable character, a transport cam disposed therebelow, hinge recesses on either side of the character and a recess in the region of the character for reducing the material accumulation, FIG. 6 shows the arrangement of the reinforcing filaments in the region of the recess and at the inner side of the printing band between two transport cams, and FIG. 7 shows the plan view of a readable character with the plan view of the recess.

An endless printing band designated as a whole by 1 and consisting in particular of rubber or synthetic rubber comprises a strand or run 2 on the outer side of which in accordance with FIG. 3 visually readable characters or digits 3 are formed. The printing band further comprises an opposite run 4 on which the printable characters 5 are disposed as shown by FIG. 2 laterally inverted and raised.

It is seen in FIGS. 1 and 5 that in each case beneath the readable characters 3, which are also raised, at the inner side of the band 1 or its run 2 inwardly projecting cams 6 are disposed on which an advancing drive for the printing band 1 can engage. The inner side 7 of the other run 4 in the region of the printable characters 5 is substantially smooth or plane in accordance with FIGS. 1 and 4 in so far as the band 1 is not bent on use and actuation. In each case between adjacent characters 3 and 5 recesses 8 extending from the outside to the inside are provided for selective band weakening which serve as hinges in the movement and deformation of the printing band 1 on adjustment thereof.

Observation of FIG. 1 gives the impression, also correct hitherto in such printing bands 1, that the run 2 with the readable characters 3 and the advancing cams 6 comprises a greater accumulation of material than the run 4. To obtain an equalization of the material accumulation of both runs 2 and 4 for the maximum possible uniformity of shrinkage of the band 1 or of a blank for making the band 1 in accordance with FIGS. 5 and 7 the run 2 comprising the readable characters 3 comprises in the region of the transport cams 6 on its outer side remote from said cams 6 recesses 9 whose lowest point 10 lies beneath the centre M of the band cross-section disposed in the region between the cams, in the example of embodiment even substantially at the level of the inner side 11 of the printing band 1 or run 2 between the cams 6. FIG. 5 in particular shows that this saves a considerable amount of material at the run 2 so that the total material accumulation at the run 2 is the same as that present at the run 4 with the printable characters 5 according to FIG. 4 It is apparent in particular also from FIG. 7 that the recesses 9 are led along the contours of a character extending in the centre region of said character 3 downward up to the lowermost point 10 thereof and in this region of the readable characters 3 in each case are open upwardly and at the lateral edge 12 of the band 1. Thus, by the recesses 9 a considerable amount of material is saved in the region of the run 2.

In FIG. 7 as readable character a "2" is illustrated which in its centre region because of the recess 9 reaches a corresponding web height In the case of closed characters such as a zero, an 8, a D or the like this recess may also be provided in the inner contour thereof to save material.

The dimension of the outwardly somewhat conically widening recess in the longitudinal or peripheral direction of the printing band 1 is somewhat less than the dimension of the character 3 oriented in this direction so that the two ends thereof in accordance with FIG. 5 have a lesser web height and consequently as a whole an adequately stable character results. Expediently, any dot 13 present in the region of the character, as necessary for example for distinguishing a "6" from a "9", is preferably disposed outside the recess 9 substantially at the edge thereof as also illustrated in FIG. 7.

If the readable character is only a dot or a dash which would be disposed substantially in the centre of the recess 9, within the recess support webs for such characters extending preferably longitudinally of the band 1 and not illustrated in the example of embodiment may be provided to prevent such characters from lateral pivoting or tilting. The support webs may even compensate for the fact that in the case of such readable characters requiring relatively little material the material saving by the recess 9 would otherwise be too great.

It is indicated in FIGS. 4, 5 and 6 that the printing band 1 may be provided with reinforcing filaments 14 extending through in the longitudinal direction thereof. These filaments must not and should not be interrupted by the recess 9 or displaced from their direction. For this reason they extend on the one hand between the cams 6 substantially in the region of the surface of the band inner side 11 and on the other hand in the region of the lowermost point 10 of the recesses 9, said surfaces or planes substantially coinciding according to the invention. The depth of the recesses 9 compared with the inner side 11 of the band 1 may be reduced between the cams 6 by the thickness of the reinforcing filaments 14 and the latter may be embedded in the band material. However, to save still more material in the region of the cams 6 in the example of embodiment it is provided that the reinforcing filaments 14 with their cross-section project partially beyond at least one of the border surfaces at the lowermost point 10 of the recess 9 and/or the inner side 11 of the band 1 between the cams 6, and in their projecting region are preferably coated with rubber or the same material as the band 1. The partially projecting filaments 14 then form a groove structure oriented in the longitudinal direction which is visible on the one hand at the inner side 11 of the band between the cams 6 and on the other on the bottom of the recess 9. This step ensures that the recesses 9 can in fact extend up to the level of the inner side 11 of the run 3 without the reinforcing filaments 14 being impaired in their path and in their efficacy.

These steps save so much material at the run 2 that both runs 2 and 4 in the production of a band of rubber, synthetic rubber or the like material, have the same or substantially the same degrees of shrinkage so that the endless band 1 can be readily made from relatively wide hose-like blanks from which it is then severed by corresponding cross-cuts. Even with a relatively large number of bands 1 spaced a small distance apart adjacent each other in said blank the cuts can be repeated precisely between the rows of characters 3 and 5 because the two runs 2 and 4 even after the shrinkage due to the same extents of shrinkage retain their correct position relatively to each other.

All features and constructional details illustrated in the description, the summary, the claims and the drawings may be of essential significance either on their own or in any combination with each other.

We claim:

1. An endless printing band for price marking devices comprising:

a first run comprising visually readable characters or digits on an outer side thereof, a second, opposite run comprising printable characters or digits disposed laterally inverted on an outer side thereof and a smooth surface on an inner side thereof associated with the printable characters, a plurality of inward projecting transport cams for advance of the printing band, each of the plurality of cams associated with one of the readable characters and disposed on an inner side of the first run, first recesses positioned between each adjacent printable and readable character and extending from the outside inwardly for selective band weakening, and second recesses provided on the first run of the printing band comprising the readable characters, each of said second recesses being aligned with the transport cam which is associated with each respective readable character on the outer side of the first run remote from the plurality of transport cams, wherein the amount of material constituting the first run is substantially equal to the amount of material constituting the second run.

2. The printing band according to claim 1, wherein the printing band is made from material selected from the group of rubber or synthetic rubber.

* * * * *